United States Patent [19]

Richardson et al.

[11] 4,199,957

[45] Apr. 29, 1980

[54] EVAPORATOR ASSEMBLY

[75] Inventors: David W. Richardson, Blairgowrie; Colin Husker, Monifieth, both of Scotland

[73] Assignee: Harker Co., Ltd., Halifax, Nova Scotia, Canada

[21] Appl. No.: 917,354

[22] Filed: Jun. 20, 1978

[51] Int. Cl.[2] ..... F25D 21/06; F25D 17/06

[52] U.S. Cl. ..... 62/275; 62/419

[58] Field of Search ..... 62/419, 275, 272, 256, 62/414

[56] References Cited

U.S. PATENT DOCUMENTS

| | | | |
|---|---|---|---|
| 2,997,131 | 8/1961 | Fisher | 62/275 X |
| 3,256,799 | 6/1966 | Beckwith et al. | 62/256 X |
| 3,324,783 | 6/1967 | Hockox | 62/256 X |
| 3,333,437 | 8/1967 | Brennan | 62/275 X |
| 3,702,544 | 11/1972 | Grinups | 62/419 X |
| 4,106,305 | 8/1978 | Ibrahim | 62/256 X |

*Primary Examiner*—Lloyd L. King

*Attorney, Agent, or Firm*—Wenderoth, Lind & Ponack

[57] ABSTRACT

An evaporator assembly for a heat transfer unit comprises a sealed thermally conductive container and a duct mounted in the container. Channels are formed between the walls of the duct and those of the container and thermal transfer fins are attached to the inside surfaces of the walls of the container and located in the channels. An evaporator extends transversely across the width of the duct and a defrosting heater bank is located downstream from the evaporator in the duct. Suitable fans and a drive motor are mounted at one end of the duct to circulate air or other gas through or across the evaporator, through the duct, and through the channels. During use of the assembly, heat is transferred from the container walls and the fins to the circulating air and the heat is then extracted from the air or gas by thermal transfer through the evaporator. The assembly provides a buffer between the heat source and the evaporator in order that the evaporator may operate in a near moisture free environment.

10 Claims, 4 Drawing Figures

EVAPORATOR ASSEMBLY

BACKGROUND OF THE INVENTION

The invention relates to an evaporator assembly.

A conventional evaporator is normally a fabrication of tubes and fins, but not necessarily so, wherein refrigerant is circulated through the tubes and a heat source for example ambient air, although other heat sources are known, is propelled through the tube-fin fabrication wherein thermal transfer takes place in the known manner from the higher temperature heat source to the lower temperature refrigerant.

This is a well known and well established function.

It is also well known that at low temperatures and in conditions of high relative humidity the moisture content in the heat source and the low temperature tube-fin fabrication combine to produce a frost or ice deposit on the tube-fin fabrication presenting a resistance to thermal transfer and obstructing the passage of the heat source through the tube-fin fabrication.

This condition is particularly pertinent to conventional evaporators when employed in vapour compression thermal transfer units such as heat pumps and the corrective action in general use is to reverse the vapour compression cycle as in the well known reverse-cycle technique whereby hot refrigerant gas is propelled through the evaporator tubes with the resultant melting of the frost or ice deposit.

This operation is energy consuming, requires a complex mechanism and controls, is ineffective in the lowest heat source temperatures and especially so where the relative humidity of the heat source is high.

Where the conventional evaporator is employed as a heat exchanger in the circuit of a thermal transfer unit such as a heat pump, supplementary or auxiliary heating is added to complement the reduction or cessation of heat transfer through the conventional evaporator.

The aim of this invention is to provide a buffer between the heat source, which could be ambient air, and the evaporator in order that the evaporator may operate in a near moisture free environment in a thermally conductive hermetically sealed container.

SUMMARY OF THE INVENTION

According to the present invention an evaporator assembly comprises a sealed thermally conductive container having rigidly connected and fixed side and end walls completely enclosing the interior of said container, a duct mounted in said container, channels formed between the walls of the duct and the container, an evaporator and defrosting unit enclosed in said duct and located out of said channels, means for circulating air or other gas through or across the evaporator, through the duct, and through the channels, and finned fabrications attached to the inside surfaces of the walls of the container and located in said channels, wherein during use of said assembly heat is transferred from the container walls and said fabrications to the circulating air or other gas and the heat is then extracted from the air or gas by thermal transfer through the evaporator.

DETAILED DESCRIPTION OF PREFERRED EMBODIMENT

Figure 1:
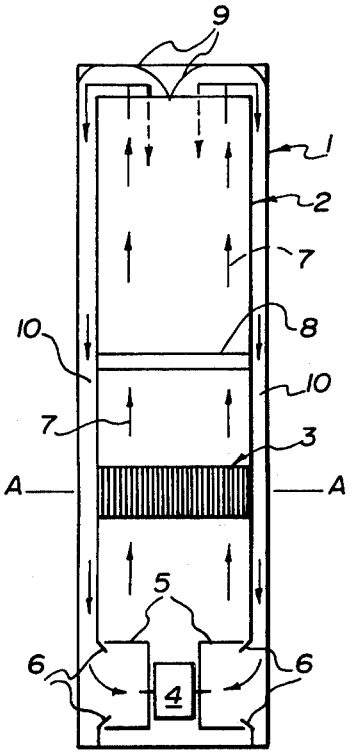
FIG. 1 is a schematic longitudinal sectional view of an evaporator assembly constructed in accordance with the present invention.
Figure 2:
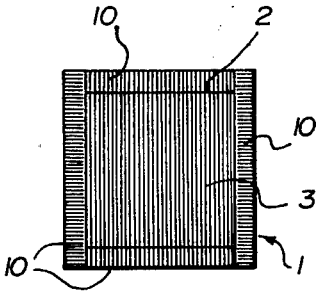
FIG. 2 is a sectional view along line A—A of FIG. 1.

FIG. 1 shows a sealed container (1) totally enclosing recirculation fans (5). An evaporator (3) is located in a duct (2) which forms a channel with the container walls (1). In the channel there is a fabrication of fins (10) attached to the inside walls of the container (1). A cowl (9) at one end of a duct (2) directs the recirculating air or other gas stream (7) into the formed channel housing the finned fabrications (10). Cowls (6) at the opposite end of the duct (2) act as guides into the suction side of the fans (5) which are rotated by a motor (4). A heater bank (8) is located in the duct (2) between the evaporator (3) and the cowls (9) to operate as a defrost unit.

As shown in FIG. 1, the container and duct are elongated and substantially square in cross-section with the walls of each being parallel to the other.

Airtight glands for the refrigerant lines, the control wires and electric supply are not shown.

Figure 3:
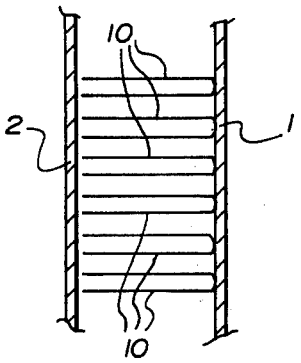
FIG. 3 is a detail view showing the manner in which fins can be attached to the inside surfaces of the container wall.

There are many known methods of providing finned fabrications and one of these is shown in FIG. 3 where U-shaped fins (10) are fixed to the container wall (1) in the channel between the container wall (1) and the duct wall (2).

Figure 4:
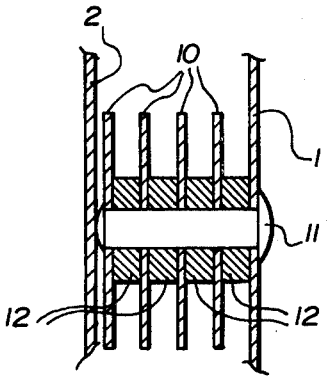
FIG. 4 is a detail view similar to FIG. 3 but showing another method of attaching the fins.

FIG. 4 is another method of finned fabrication where a rivet (11) of thermally conductive material secures an assembly of thermally conductive fins (10) alternating with thermally conductive spacers (12) to the container wall (1).

When the sealed thermally conductive container is situated in a heat source which could be ambient air and refrigerant at low temperature is circulated through the tubes of the evaporator with air or other gas of low moisture content being propelled through or across the evaporator thermal transfer takes place in the established manner from the higher temperature heat source through the thermally conductive container walls to the finned fabrications; from the higher temperature recirculating air or other gas to the lower temperature refrigerant in the evaporator; from the higher temperature walls of the container and the finned fabrications to the lower temperature recirculating air or other gas.

The recirculating air or other gas of low moisture content entering the suction influence of the fans (5) through the guide cowls (6) has acquired a heat gain from the container walls (1) and the finned fabrications (10). Further heat is gained from the drive motor (4) as the stream is directed by the fans (5) to and through or across the evaporator (3) where thermal transfer takes place from the higher temperature recirculating air or other gas to the lower temperature refrigerant circulating in the tubes of the evaporator. The cooled air or other gas leaving the evaporator (3) is expelled through the duct (2) and directed by cowls (9) into the channels formed by the duct walls (2) and the container walls (1) and is propelled through the finned fabrications (10) where thermal transfer takes place from the heat source through the container wall (1) and the finned fabrications (10) to the lower temperature recirculating air or other gas and the thermal transfer cycle is complete.

In this sealed condition where the volume of air or other gas recirculating within the container is low the relative humidity of the air or other gas could be high but would not contain sufficient grains of moisture to produce an effective frost or ice deposit on the fabrication of the evaporator.

Should the container be charged with air or other gas at a temperature of 60 degrees F. and at a relative humidity of 100%, the number of grains of moisture in the sealed container would be less than 300 where the volume of the sealed container was 50 cubic feet or less.

It is possible however to charge the sealed container with air or other gas entirely free of moisture and in this state the optimum condition would prevail.

In low temperature heat source conditions frost or ice will deposit on the outside surfaces of the sealed container but as long as the thermal transfer unit such as a heat pump is operating against a control thermostat the cycling action of the heat pump will be sufficient to provide a satisfactory defrost or de-icing action assuming that the heat source is above the freezing point of water.

When the thermal transfer unit such as a heat pump is operating continuously such as at design conditions frost or ice will be deposited on the outside surfaces of the container.

The required surface area of the sealed container is dictated by the formula $$Tr/TixTd$$

and is in square feet where:

Tr is the total amount of thermal transfer required from the thermal transfer unit in Btu/hour;

Ti is the thermal conductivity through a selected thickness of frost or ice deposit in Btu/hour/square foot/1 degree F.;

Td is the effective temperature difference between the heat source and the recirculating air or other gas in degrees F.

Where the stated thickness of frost or ice deposit exceeds the design thickness, whether this be produced by abnormal conditions or design miscalculation, the defrost unit will be operated to defrost or de-ice the outside surfaces of the sealed container by the simple function of raising the temperature of the recirculating air or other gas and producing a high temperature on the inside surfaces of the container walls. The operation will be effective in a very short period and without interruption to the thermal transfer function of the evaporator.

The formula could be applied so that the evaporator assembly when operating at design conditions requires only one defrost period per day. However it must be noted that heating design engineers may find it convenient to specify two or more periods of defrost action per day thus reducing the required surface area of the sealed container.

When the evaporator assembly is employed in the circuit of a thermal transfer unit such as a heat pump the complex reverse-cycle technique of defrosting is eliminated and there is no requirement for supplementary or auxiliary heating.

The sealed container can be of any shape and not necessarily as shown in the schematic drawings and the effective surface area of the sealed container can be increased by the addition of any of many well known methods of surface extension to the outside walls of the sealed container.

The design of the evaporator assembly allows the vapour compression unit in a thermal transfer system such as a heat pump to be housed within the sealed container in such a manner that the vapour compression unit and its associated components are in the recirculating air or other gas stream (7) and between the fans (5) and the evaporator (3) whereby the total heat output produced by the vapour compression unit and its associated components is recovered by the evaporator.

What we claim as our invention is:

1. An evaporator assembly comprising a sealed thermally conductive container having rigidly connected and fixed side and end walls completely enclosing the interior of said container, a duct mounted in said container, channels formed between the walls of the duct and the container, an evaporator and defrosting unit enclosed in said duct and located out of said channels, means for circulating air or other gas through or across the evaporator, through the duct, and through the channels, and finned fabrications attached to the inside surfaces of the walls of the container and located in said channels, wherein during use of said assembly heat is transferred from the container walls and said fabrications to the circulating air or other gas and the heat is then extracted from the air or gas by thermal transfer through the evaporator.

2. An evaporator assembly as in claim 1 wherein the sealed thermally conductive container is charged with moisture free air or other gas.

3. An evaporator assembly as in claim 1 where the effective surface area of the sealed thermally conductive container is increased by the attachment of thermally conductive fins to the outside surfaces.

4. An evaporator assembly as in any one of claims 1 to 3 wherein the defrosting unit comprises a heater bank, defrosting of the outer surface of the sealed thermally conductive container is effected by raising the temperature of the circulating air or other gas through or across the heater bank, and the action of thermal transfer through the evaporator is uninterrupted by the defrosting process.

5. An evaporator assembly according to claim 1 wherein both the container and duct are elongated and substantially square in cross-section with the walls of each being parallel to respective walls of the other.

6. An evaporator assembly according to claim 1 wherein said circulating means comprises fan means and a motor for rotating said fan means, said fan means and motor being mounted in said container.

7. An evaporator assembly according to claim 5 wherein said finned fabrications extend in the longitudinal direction of said container and substantially the length of said channels.

8. An evaporator assembly according to claim 1 wherein said evaporator extends transversely across the complete width of the duct and is located part way along the length of the duct.

9. An evaporator assembly according to claim 8 wherein said defrosting unit is a heater bank located downstream from said evaporator in the direction of circulation of said air or gas in the duct.

10. An evaporator assembly according to claim 9 wherein said circulating means is located at the upstream end of said duct and at one end said sealed container.

* * * * *